United States Patent [19]

Hanson et al.

[11] Patent Number: 4,878,465

[45] Date of Patent: Nov. 7, 1989

[54] CONTROL FOR AUTOMATICALLY STARTING A DIESEL ENGINE

[75] Inventors: Jay L. Hanson, Bloomington; Leland L. Howland, Belle Plaine, both of Minn.

[73] Assignee: Thermo King Corporation, Minneapolis, Minn.

[21] Appl. No.: 236,887

[22] Filed: Aug. 26, 1988

[51] Int. Cl.[4] ..... F02N 11/08

[52] U.S. Cl. ..... 123/179 BG; 123/179 G; 290/38 C

[58] Field of Search ..... 123/179 B, 179 BG, 179 G, 123/179 H; 290/38 C

[56] References Cited

U.S. PATENT DOCUMENTS

| | | | |
|---|---|---|---|
| 2,984,993 | 5/1961 | Carraway | 123/179 B |
| 3,371,656 | 3/1968 | Stauffer et al. | 123/179 H |
| 3,691,393 | 9/1972 | Papachristou | 123/179 H |
| 3,708,683 | 1/1973 | Howland | 123/179 H |
| 3,862,429 | 1/1975 | Bucher | 123/179 B |
| 4,421,075 | 12/1983 | Mandel | 123/179 BG |
| 4,475,493 | 10/1984 | Masteller et al. | 123/179 B |

*Primary Examiner*—Andrew M. Dolinar
*Attorney, Agent, or Firm*—D. R. Lackey

[57] ABSTRACT

Electrical control apparatus for automatically starting a Diesel engine. The apparatus includes start, preheat and run relays which respectively control the energization of a starting solenoid, glow plugs, and a fuel solenoid. The energization of the start, preheat and run relays is controlled by a control module which drives the preheat relay as soon as the control module is energized. The glow plug preheat time is measured, and the run and start relays are respectively energized just prior to, and at the termination of the preheat time. Engine cranking time and speed are monitored, dropping the start and preheat relays when the engine starts, and also when the engine speed fails to reach certain thresholds within first and second predetermined periods of time. The run relay continues to energize an electrical circuit which includes an engine reset switch and a low oil pressure switch. The engine reset switch de-energizes the control module, and thus the run relay, in the event the engine fails to start.

13 Claims, 7 Drawing Sheets

CONTROL FOR AUTOMATICALLY STARTING A DIESEL ENGINE

TECHNICAL FIELD

The invention relates in general to the starting of Diesel engines, and more specifically to the automatic starting of Diesel engines used to drive compressors in transport refrigeration systems.

BACKGROUND ART

U.S. Pat. No. 4,419,866, which is assigned to the same assignee as the present application, discloses a transport refrigeration system in which a Diesel engine which drives a refrigerant compressor may be selectively operated in continuous or start-stop modes. In the start-stop mode, the Diesel engine is under the control of a refrigeration thermostat, being stopped and re-started as the temperature of the refrigeration system enters and leaves predefined temperature bands relative to a selected temperature set point. While the control circuitry disclosed in the patent performs well, it would be desirable, and it is the object of the present invention, to simplify the control and improve the logic, without loss of required functions.

DISCLOSURE OF THE INVENTION

Briefly, the present invention provides a single control module which contains all the logic required to start and stop the Diesel engine under control of a refrigeration system thermostat. The control apparatus for automatically starting and stopping a Diesel engine includes start, preheat and run relays, with the logic of the single control module permitting the relays to have single-pole, single-throw (SPST) switch contacts, instead of three-pole, double-throw (3PDT) required by the prior art control. The SPST switch contacts of the start, preheat and run relays respectively control the energization of a starting solenoid, glow plugs, and a fuel solenoid. The SPST switch contacts of the run relay additionally provide electrical power to a circuit which includes a low oil pressure switch having contacts which are closed until the engine oil pressure exceeds a predetermined value, and an engine reset switch.

The electrical control is arranged such that application of electrical power to the control module immediately results in driving the preheat relay, to start engine preheating with the glow plugs. The preheat time is controlled by first timer means to provide a preheat time which is responsive to engine coolant temperature, with the first timer means providing a first signal just prior to the end of the preheat time, which drives the run relay, and a second signal at the end of the preheat time, which drives the start relay. Engine speed and cranking time are logically related by second timer means and first and second logic means, to drop the preheat and start relays when the engine starts, and also when the engine speed fails to exceed first and second predetermined values before the expiration of first and second predetermined periods of time. The electrical circuit powered by the contacts of the run relay monitors failure of the engine to start, with the engine reset switch de-energizing the control module, and thus the run relay, in response to such a failure to start.

BRIEF DESCRIPTION OF THE DRAWINGS

The invention will become more apparent by reading the following detailed description in conjunction with the drawings, which are shown by way of example only, wherein.

DESCRIPTION OF PREFERRED EMBODIMENTS

U.S. Pat. No. 4,419,866 is hereby incorporated into the specification of the present application by reference, and details of a transport refrigeration system which are not essential to the understanding of the present invention will not be shown and described.

Figure 1:
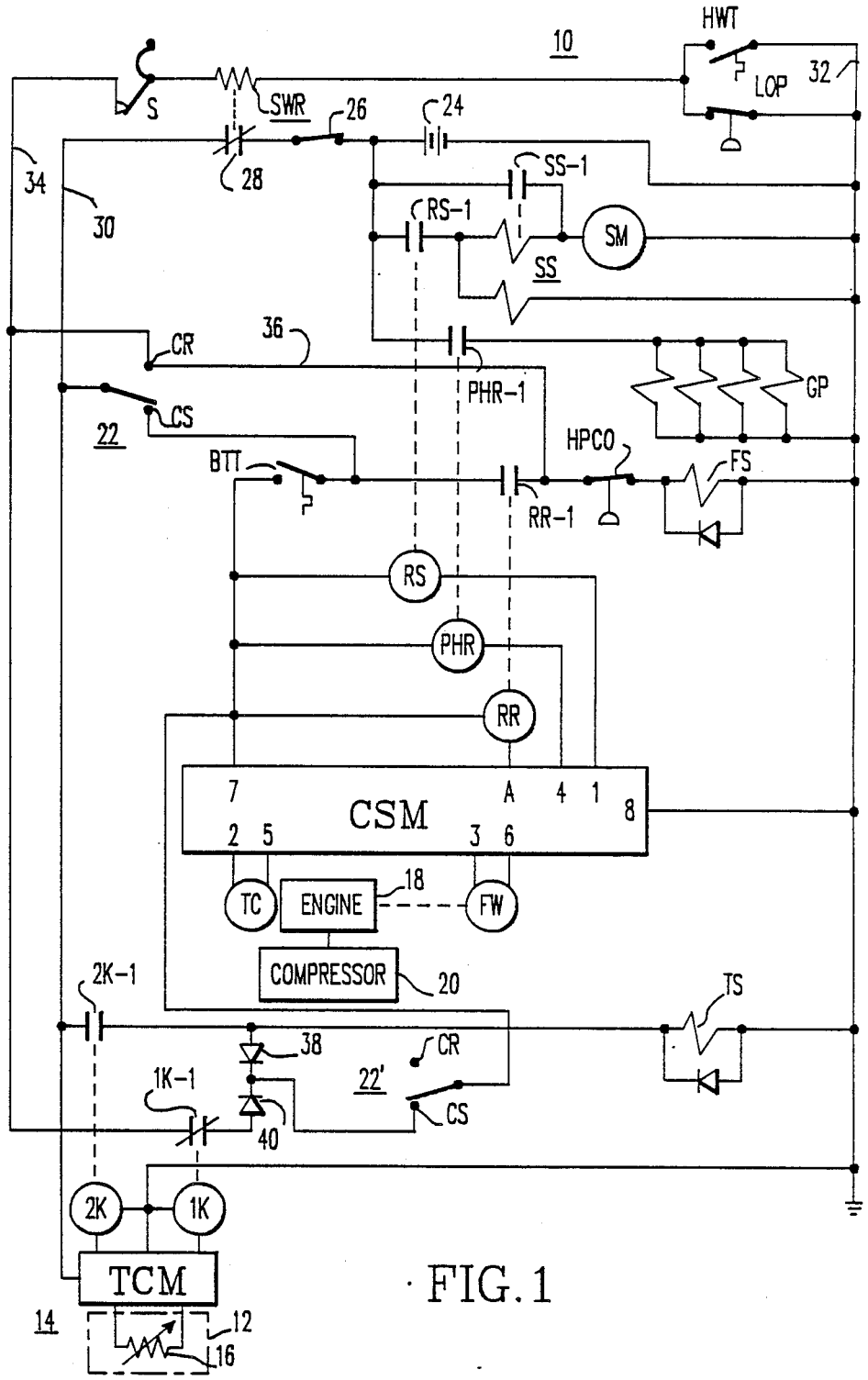
FIG. 1 is a schematic diagram of electrical control for automatically starting a Diesel engine driving a refrigerant compressor under control of a refrigeration thermostat, according to the teachings of the invention.

Referring now to the drawings, and to FIG. 1 in particular, there is shown electrical control 10 for a transport refrigeration system suitable for conditioning the air in the served space 12 of a truck, trailer, refrigerated container, and the like. Control 10 includes a thermostat 14 which includes a temperature control module (TCM), and a sensor 16 disposed in the served space 12. Thermostat 14 controls the operation of the transport refrigeration system via an engine speed relay 2K and a heat relay 1K. Relay 2K selects one of two operating speeds for a Diesel engine 18 connected to a refrigerant compressor 20, when the Diesel engine 18 is operating, via its normally open contacts 2K-1 and a throttle solenoid TS. When relay 2K is energized, it closes contacts 2K-1 to energize the throttle solenoid TS, which in turn selects the higher of the two operating speeds, such as 2200 RPM. When relay 2K is de-energized, contacts 2K-1 open to de-energize the throttle solenoid TS and select the lower of the two operating speeds, such as 1400 RPM. When relay 1K is de-energized, it has contacts (not shown) which select a cooling mode for the transportation apparatus which cools the served space 12, and when relay 1K is energized, its contacts select a heating mode which heats the served space 12, as required to maintain a predetermined temperature set point. Relay 1K additionally has normally closed contacts 1K-1, shown in FIG. 1.

Figure 2:
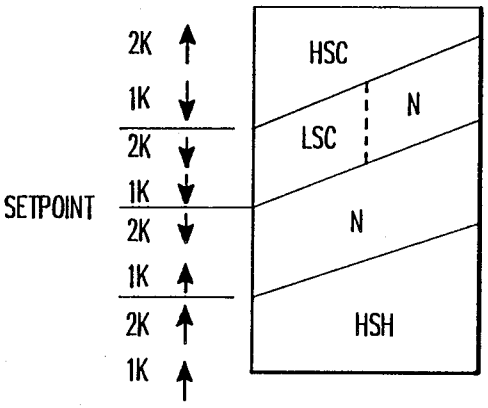
FIG. 2 diagrammatically illustrates temperature bands relative to a selected temperature set point which result in stopping and starting of the Diesel engine.
Figure 4A:
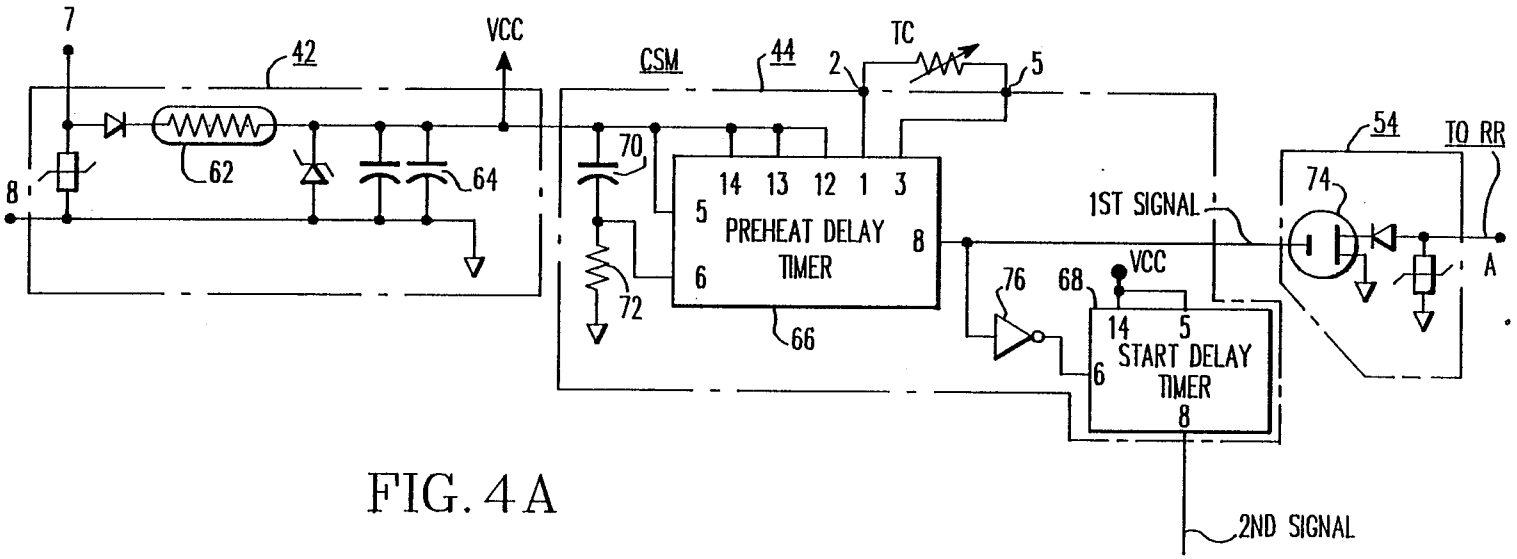
FIGS. 4A and 4B are a detailed schematic diagram illustrating a preferred implementation of the control module shown in FIGS. 1 and 3.

FIG. 2 illustrates the operation of thermostat 14 and relays 2K and 1K, with operation during a falling temperature in the served space 12 being illustrated along the left-hand side of the diagram, and operation during a rising temperature in the served space along the right-hand side. When the termperature of the served space 12 is in a first temperature band HSC above a selected set point, cooling at the maximum rate is required and relay 2K is energized to select the higher of the two Diesel engine and compressor speeds, and relay 1K is de-energized to select the cooling mode. As the temperature of the served space 12 drops and enters a band LSC adjacent to set point, less cooling is required, and relay 2K drops to select the lower of the two engine and compressor speeds. When the temperature of the served space 12 drops below set point, into a temperature band N, relay 1K picks up, switching the refrigeration system to the heating mode. In the start-stop operation of the electrical control 10, manually selected by operating the ganged selector switches 22 and 22' to position CS, Diesel engine 18 is stopped in the temperature band N (null). Should the temperature of the served space 12 continue to drop and reach band HSH, relay 2K will pick up and the Diesel engine 18 will be started. The Diesel engine may be started in high speed; or, as described in the incorporated patent, as well as in U.S. Pat. No. 4,325,224, which is assigned to the same assignee as the present application, engine fuel may be conserved by starting the engine in low speed, and maintaining low speed operation for a predetermined period of time. If the temperature has not risen into band N by the end of this time, then the engine switches from low speed to high speed operation.

With a rising temperature in the served space, the null band N during which the Diesel engine is not operated may extend above set point, notwithstanding the de-energization of relay 1K. If the temperature rises into band HSC, the Diesel engine is started. Again, it may be started in high or low speed, as desired. If it is started in low speed, and the temperature has not fallen into band LSC by the end of the predetermined time, then the Diesel engine will be switched from low to high speed.

Returning now to FIG. 1, a control module CSM controls the energization of a preheat relay PHR, a run relay RR and a start relay RS. Relays PHR, RR and RS each have a single set of normally open SPST contacts, referenced PHR-1, RR-1 and RS-1, respectively. A battery 24, an on-off switch 26 and contacts 28 of an engine reset switch SWR provide power to power conductors 30 and 32. Conductor 32 is connected to chassis ground.

A starter solenoid SS is energized by conductors 30 and 32 when start relay RS picks up to close its contacts RS-1. Starter solenoid SS closes its contacts SS-1 when energized to connect starter motor SM between conductors 30 and 32.

Glow plugs GP for preheating Diesel engine 18 prior to starting are connected between power conductors 30 and 32 when preheat relay PHR is energized, closing its contacts PHR-1.

Fuel solenoid FS is connected between power conductors 30 and 32 via a high pressure cutout switch HPCO, contacts CS of manual selector switch 22, and contacts RR-1 of run relay RR. Thus, energizing run relay RR energizes the fuel solenoid FS, supplying fuel to Diesel engine 18.

Run relay RR, when energized, also provides power to an auxiliary power conductor 34 by a circuit which extends from power conductor 30 to auxiliary power conductor 34 via contact CS of switch 22, contacts RR-1 of run relay RR, and conductor 36. Auxiliary power conductor 34 provides power for an engine protective circuit which includes reset switch SWR, a normally closed low engine oil pressure switch LOP, a normally open high water temperature switch HWT, and a normally closed contact S of a manual preheat switch.

Providing power to input terminal 7 of control module CSM initiates the starting sequence for Diesel engine 18. Input terminal 8 is connected to chassis ground 32. An engine temperature sensor TC is connected to input terminals 2 and 5, and an engine flywheel sensor FW is connected to input terminals 3 and 6. Relays RS, PHR and RR are respectively connected from input terminal 7 to input terminals 1, 4 and A.

Electrical power is provided to control module CSM from main power conductor 30 when speed relay 2K is energized via contacts 2K-1, a diode 38, and contact position CS of selector switch 22'. Electrical power is also provided to control module CSM from auxiliary power conductor 34 when heat relay 1K is de-energized via contacts 1K-1, a diode 40, and contact position CS of switch 22'. Automatic starts of Diesel engine 18 may also be made when the battery voltage drops, to recharge the battery, as well as when the engine block temperature drops to a predetermined value. For example, FIG. 1 illustrates providing power to input terminal 7 of control module CSM via block temperature thermostat BTT.

In the operation of control 10, when the refrigeration system is initially activated, the temperature of the served space 12 will be in range HSC, and the speed relay 2K will be energized. Contacts 2K-1 provide power to control module CSM from main power conductor 30, initiating the starting of Diesel engine 18. As will be more fully described, control module CSM will immediatedly drive the preheat relay PHR, to initiate preheating of the Diesel engine 18, the run relay RR will be energized just prior to the completion of the preheat time, and the start relay RS will be energized at the end of the preheat time. When the engine starts, the preheat and start relays PHR and RS will be de-energized, while the run relay RR continues to be energized to power the auxiliary power conductor 34. Thus, when the temperature of the served space 12 drops into range LSC, power to control module CSM will continue to be provided via contacts 1K-1 of the heat relay.

When the temperature in the served space 12 drops below set point into the null range N, the heat relay picks up, terminating power to control module CSM, stopping Diesel engine 18. A continued drop in temperature to range HSH will restart engine 18 via contacts 2K-1. A rise back into range N stops engine 18. A temperature rise above set point continues the null range N, as the auxiliary power conductor will be de-energized, preventing engine 18 from restarting when the heat relay 1K drops. When the temperature rises into range HSC, relay 2K picks up to start engine 18.

Figure 3:
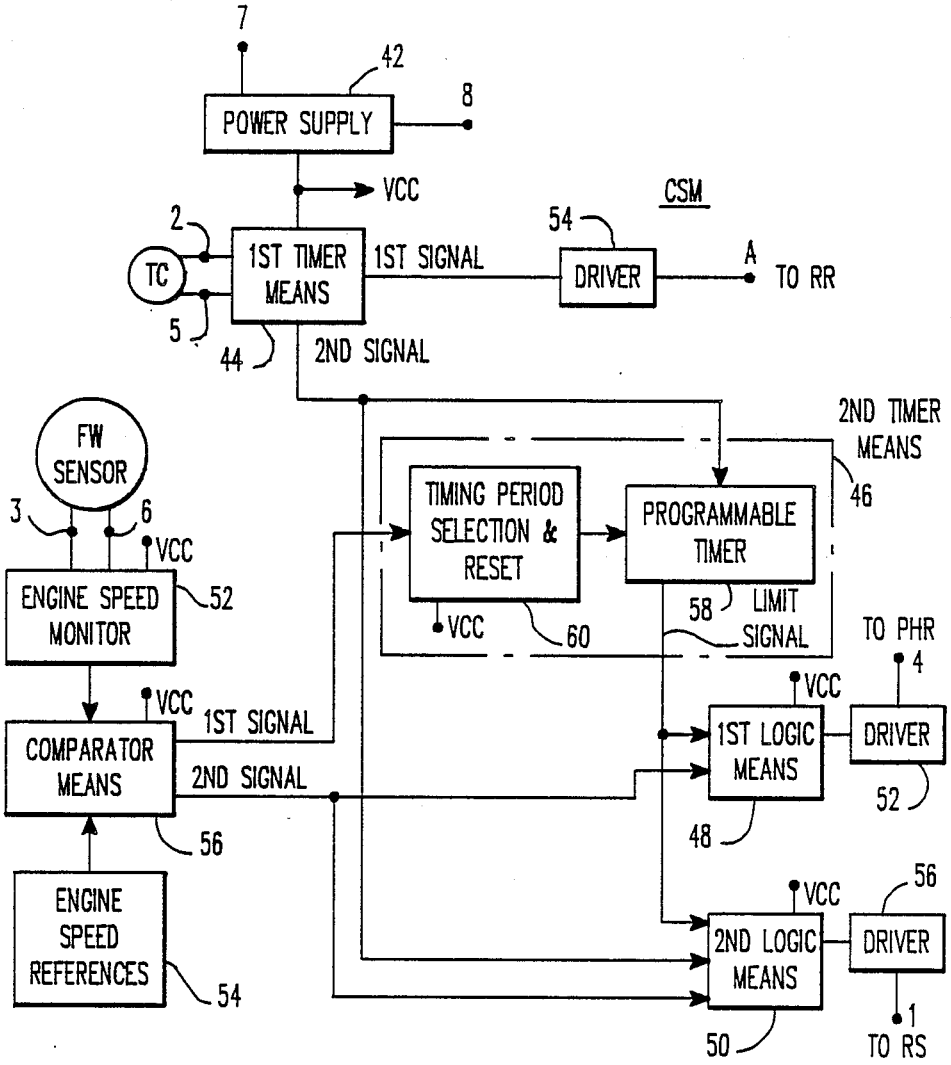
FIG. 3 is a functional block diagram of a control module shown in FIG. 1.
Figure 4B:
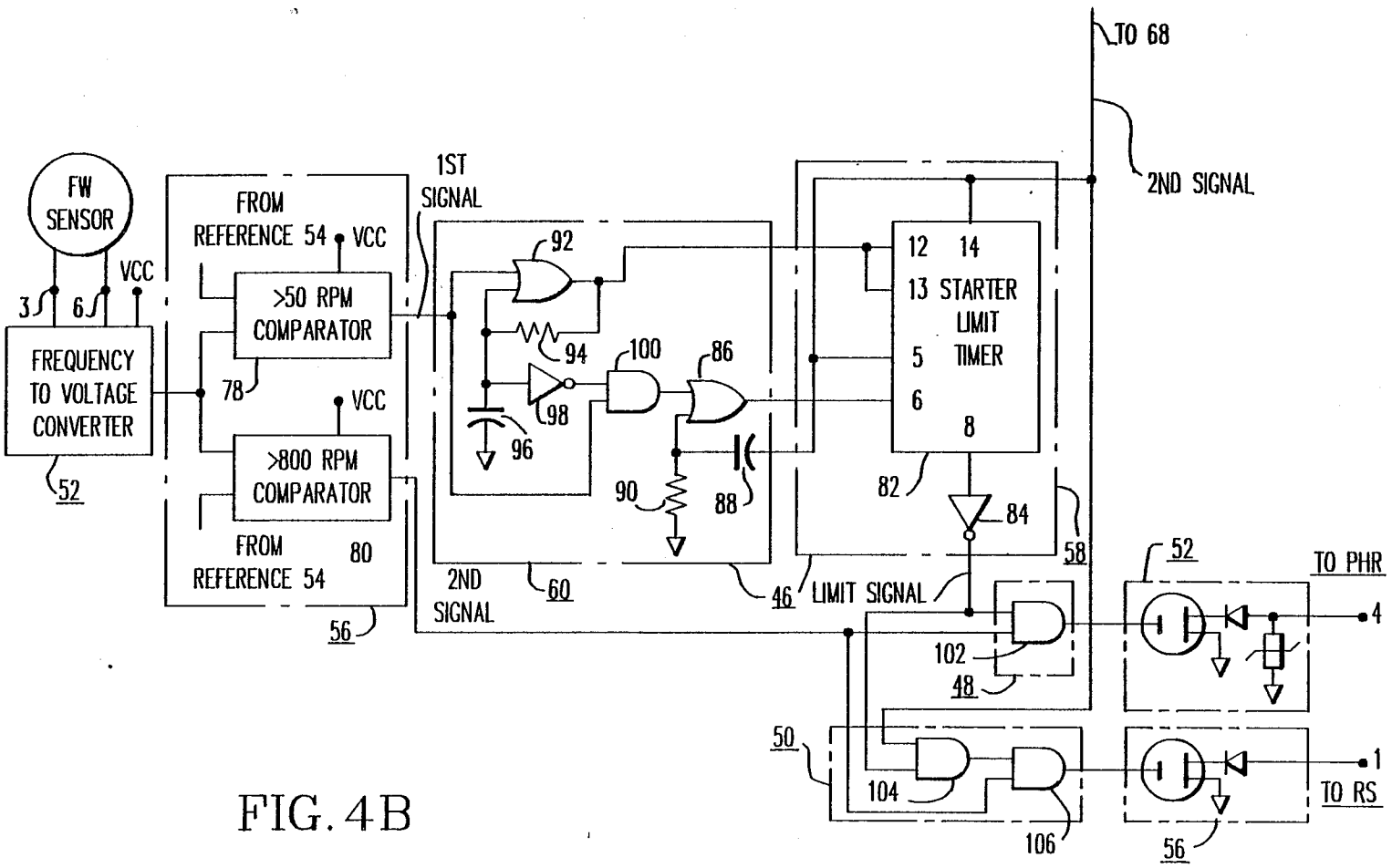

A functional block diagram of control module CSM is shown in FIG. 3, a preferred implementation of the block diagram is shown in FIG. 4, and FIGS. 5, 6 and 7 are timing diagrams which illustrate the operation of the preferred implementation of control module CSM. The functional block diagram of FIG. 3 includes a power supply 42 which is energized by input terminal 7 when electrical power is provided to control module CSM by any one of the hereinbefore described circuits in FIG. 1. Control module CSM further includes first and second timer means 44 and 46, respectively, first and second logic means 48 and 50, respectively, relay drivers 52, 54 and 56 for driving relays PHR, RR and RS, respectively, an engine speed monitor 52 connected to the flywheel sensor FW, reference means 54 for providing predetermined engine reference speeds, and a comparator 56.

In the operation of the functional block diagram of control module CSM, when the control module CSM is energized by power applied to input terminal 7, power supply 42 provides a control voltage VCC. The logic levels are such that upon power-up, the first logic means 48 activates driver 52, to energize the preheat relay PHR and the glow plugs GP. The first timer means 44 is also activated upon power-up to provide a variable pre-heat time responsive to the temperature of engine 18, indicated by engine temperature sensor TC. Timer means 44 provides a first signal a few seconds before the end of the preheat time, which activates driver 54 to energize run relay RR, the fuel solenoid, the engine protective circuit which includes the engine reset switch SWR, the refrigeration controls (not shown) of the transport refrigeration system, and the battery charging alternator field (not shown). The first timer means 44 then provides a second signal at the end of the preheat time to which the second logic means responds by activating driver 56, which in turn starts the cranking of engine 18. The second signal provided by the first timer means also energizes the second timer means 46 to time the cranking and to provide a limit signal which terminates the engine preheat and cranking when the engine 18 starts, and also at first or second points in the engine cranking cycle, when the engine fails to start.

The second timer means 46 includes a programmable timer 58, and a timing period selection and reset function 60 responsive to engine speed. Comparator means 56 provides a first signal when the engine speed exceeds a predetermined low value, such as 50 RPM, and a second signal when the RPM reached a value which indicates the engine has started, such as 800 RPM. Selector function 60 initially sets timer 58 to time out and provide the limit signal after a first predetermined period of time, which is a relatively short time, such as 3 to 5 seconds. If the engine speed does not reach 50 RPM before the end of the first predetermined period of time, timer 58 times out and provides the limit signal to the first and second logic means 48 and 50, respectively. Logic means 48 and 50 deactivate drivers 52 and 56, dropping the preheat and start relays PHR and RS. If the engine speed reaches 50 RPM before the end of the first predetermined period of time, function 40 resets timer 58 and programs it to time out after a second predetermined period of time, such as 25 to 30 seconds. If engine 18 fails to reach 800 RPM before the end of the second period of time, the limit signal is provided by timer 58, resulting in the dropping of relays PHR and RS. If the engine starts before the end of the second predetermined period of time, the second signal provides by comparator 56 functions as a limit signal for logic means 48 and 50, dropping relays PHR and RS.

The run relay RR remains energized after relays PHR and RS drop. If engine 18 failed to start, the low oil pressure switch LOP shown in FIG. 1 will be closed, energizing the engine reset switch SWR via the closed contacts RR-1 of the run relay RR. After a predetermined period of time, reset switch SWR will open its contacts 28 to terminate power to the control module, and the run relay RR will then drop out. Engine 18 cannot then be automatically started until switch SWR is manually reset and power is reapplied to control module CSM.

Referring now to a preferred embodiment of the control module CSM, power supply 42 includes a negative temperature coefficient resistor 62 to aid cold weather starting. Resistor 62 maintains maximum VCC voltage across capacitor 64 during voltage dips when starter motor SM is energized. Capacitor 64 will charge and discharge with an RC time constant determined by resistor 62 and capacitor 64, with resistor 62 having a resistance of 22 ohms at 70 degrees F., and a resistance of 68 ohms at −40 degrees F.

The first timer means 44 includes first and second timers 66 and 68, referred to as preheat delay and start delay timers, respectively. For purposes of example, timers 66 and 68 will be CMOS programmable timer type LM4541. Capacitor and resistor 70 and 72, respectively, provide a high to low transition for master reset input terminal #6 of timer 66 upon power-up, assuring that timer 66 is properly set to zero, and that full preheat time is accomplished. Preheat delay timer 66 will time out after a period of time determined by the temperature of engine 18, as sensed by engine temperature sensor TC. When timer 66 times out, terminal #8 goes high to activate driver 54 and energize run relay RR. Driver 54 includes a solid state switch in the form of a HEXFET, selected for low "on" resistance to prevent drop-out of relay RR during voltage dips when starter motor SM is energized. Drivers 52 and 56 are of similar construction.

Output terminal #8 of timer 66 is connected to the master reset input terminal #6 of timer 68 via an inverter gate 76. Thus, when timer 66 times out and its output goes high, gate 76 provides a high to low transition which starts timer 68. The timing period of timer 66 plus the timing period of timer 68 provide the preheat time for engine 18, with timer 68, when it times out and provides a high output at terminal #8, providing the signal which starts engine cranking.

The flywheel sensor FW, which may be magnetic pick-up which senses the teeth on the ring gear, provides signals for the engine speed monitor 52. Engine speed monitor is a frequency to voltage converter, such as type LM2917, which converts the frequency of the pulses provided by sensor FW to a DC voltage. The output of converter 52 is applied to comparator 56. Comparator 56 includes first and second comparators 78 and 80, respectively, such as comparator type LM2901. Reference 54 may be a resistor voltage divider connected from VCC to ground, providing a reference voltage for comparator 78 indicative of about 50 RPM, and a reference voltage for comparator 80 indicative of about 800 RPM. Comparator 78 provides a low output below 50 RPM and a high output above 50 RPM, while comparator 80 provides a high output below 800 RPM and a low output above 800 RPM.

The programmable timer 58 of the second timer means 46 includes a timer 82, which may be type LM4541, and an inverter gate 84. Timer 82 is energized by the second signal of the first timer means 44. When timer 68 times out and its output goes high, OR gate 86, capacitor 88 and resistor 90 provide a high-low input to master reset terminal #6, to provide a proper reset for timer 82. An OR gate 92 of timing period selection and reset means 60 of the second timer means 46, in response to the low output of comparator 78 when the speed of engine 18 is below 50 RPM, sets the first timing period of timer 82 to a count of 8192 by applying logic zeros to input terminals #12 and #13. If the engine speed exceeds 50 RPM before the first timing period times out, the output of comparator 78 switches high, the output of OR gate 92 goes high to apply logic ones to terminals #12 and #13, which selects a count of 65,536, and resistor 94, capacitor 96, inverter gate 98, AND gate 100 and OR gate 86 provide a high to low transition which resets timer 82 to zero, to start the second timing period.

The first logic means 48 is a provided by an AND gate 102, and the second logic means 50 is provided by AND gates 104 and 106. Inputs of AND gate 102 are provided by the limit signal out put of the second timer means, which is the inverted output of starter limit timer 82, and by the output of the second comparator 80. When power is first applied to control module CSM, the inverted output of timer 82 will be a logic one, and since the engine speed will be below 800 RPM at this time, comparator 80 provides a logic one. AND gate 102 thus outputs a logic one which turns on driver 52 to drive the preheat relay PHR and energize glow plugs GP. Inputs of AND gate 104 are provided by the second signal from the first timing means, ie., the "start" signal, and by the limit signal output of timer 58. Thus, when the preheat time expires and the output of timer 68 goes high, AND gate 104 outputs a logic one as the limit signal will also be high at this point in time. AND gate 106 thus has a logic one input from AND gate 104, and its other input is responsive to the output of comparator 80, which is a logic one until the engine speed exceeds 800 RPM. Thus, AND gate 106 outputs a logic one to activate driver 56 and energize the start relay RS.

Figure 5:
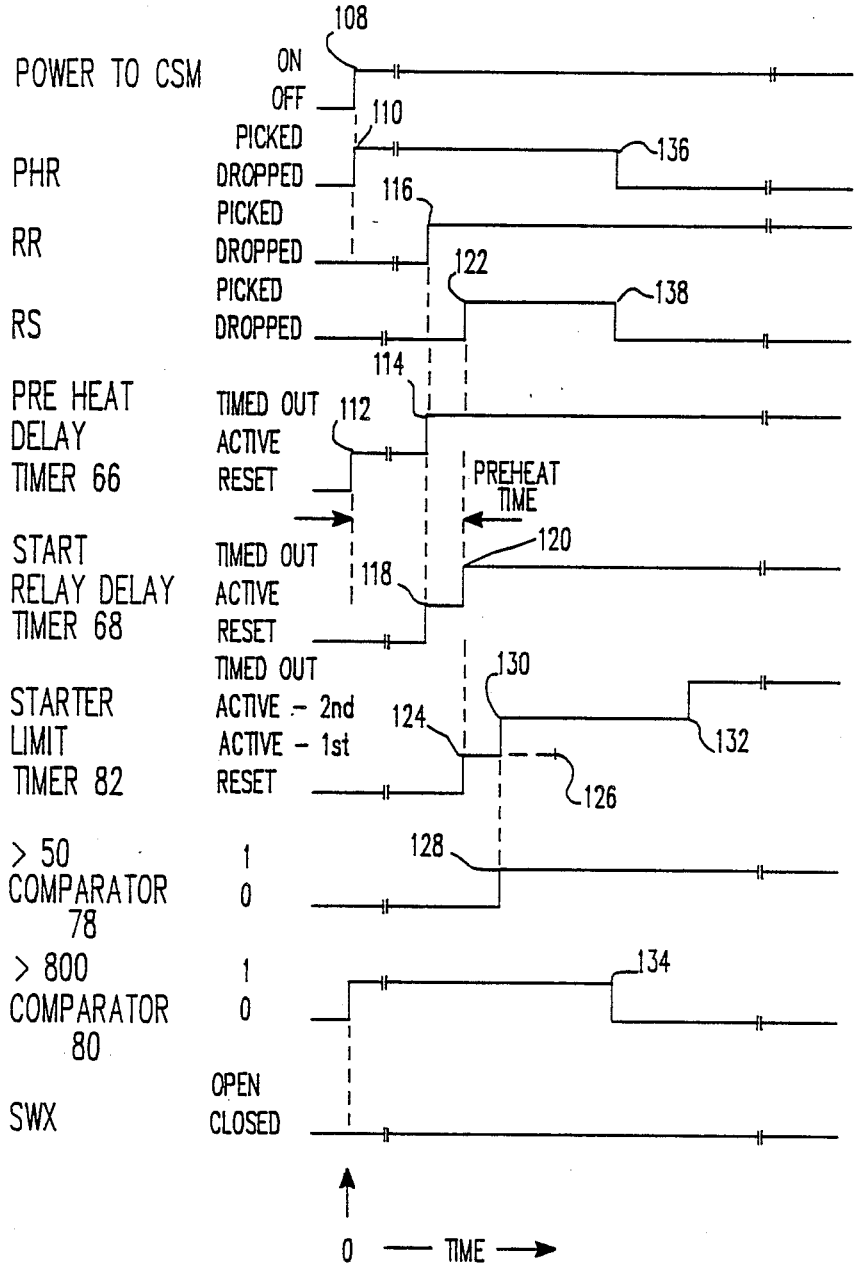
FIG. 5 is a timing diagram which illustrates the operation of the control module shown in FIG. 4 for a normal engine start.

In the operation of control module CSM, it will first be assumed that engine 18 starts normally, with the timing diagram of FIG. 5 illustrating a normal start. When power is applied to control module CSM, indicated at 108 in FIG. 5, AND gate 102 immediately applies a logic one to driver 52, and the preheat relay picks up at 110. The preheat delay timer 66 also becomes active at this point, indicated at 112.

When the preheat delay timer 66 times out at 114, the run relay RR picks up at 116 and the start delay timer 68 becomes active at 118. When the start delay timer 68 times out at 120, signifying the end of the engine preheat time, the start relay RS is energized at 122 and the starter limit timer 82 starts timing the first predetermined period of time, which if not reset, will time out at point 126.

Before the first predetermined period of time times out at point 126, the engine speed exceeds 50 RPM and the output of comparator 78 switches high at 128 to reprogram and reset starter limit timer 82 at point 130. Before the starter limit timer 82 reaches the end 132 of the second predetermined period of time, the engine speed exceeds 800 RPM at point 134, signifying that engine 18 has started, the output of comparator 80 goes low, and the preheat and start relays PHR and RS drop at points 136 and 138, respectively.

When the temperature of the served space 12 reaches the null range N, power to control module CSM is terminated and the run relay RR will drop. Reapplication of power to control module CSM will start the sequence again, resetting the timers as hereinbefore described.

Figure 6:
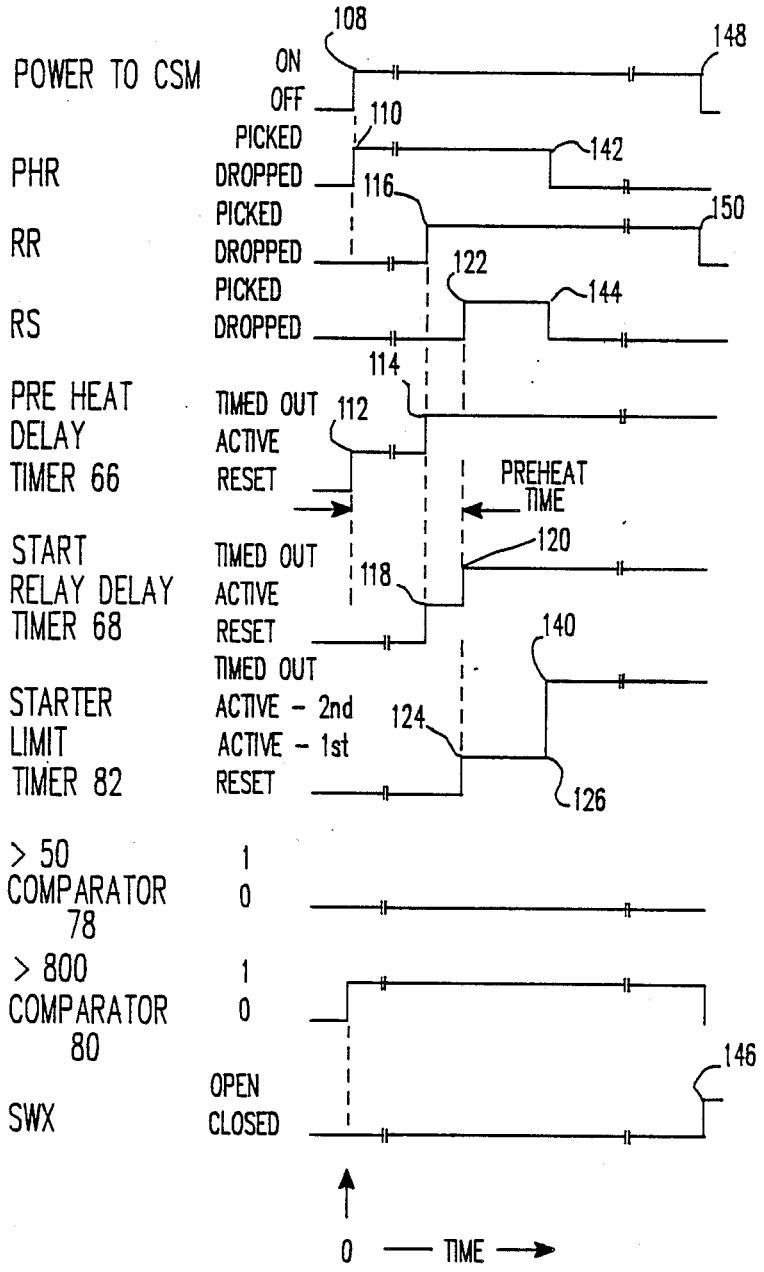
FIG. 6 is a timing diagram which illustrates the operation of the control module shown in FIG. 4 for a failure of the Diesel engine speed to exceed a first predetermined value within a first predetermined period of time.

The timing diagram of FIG. 6 indicates the operation of control module CSM when engine 18 fails to reach 50 RPM during the first timing period. Instead of comparator 78 switching to a logic one before the starter limit timer 82 reaches the end 126 of the first predetermined period of time, timer 82 reaches point 126 and times out at 140. This drops preheat and start relays PHR and RS at points 142 and 144, respectively. The engine reset switch SWX remains energized until it operates at point 146 to remove power from control module CSM at 148 and drop run relay RR at 150.

Figure 7:
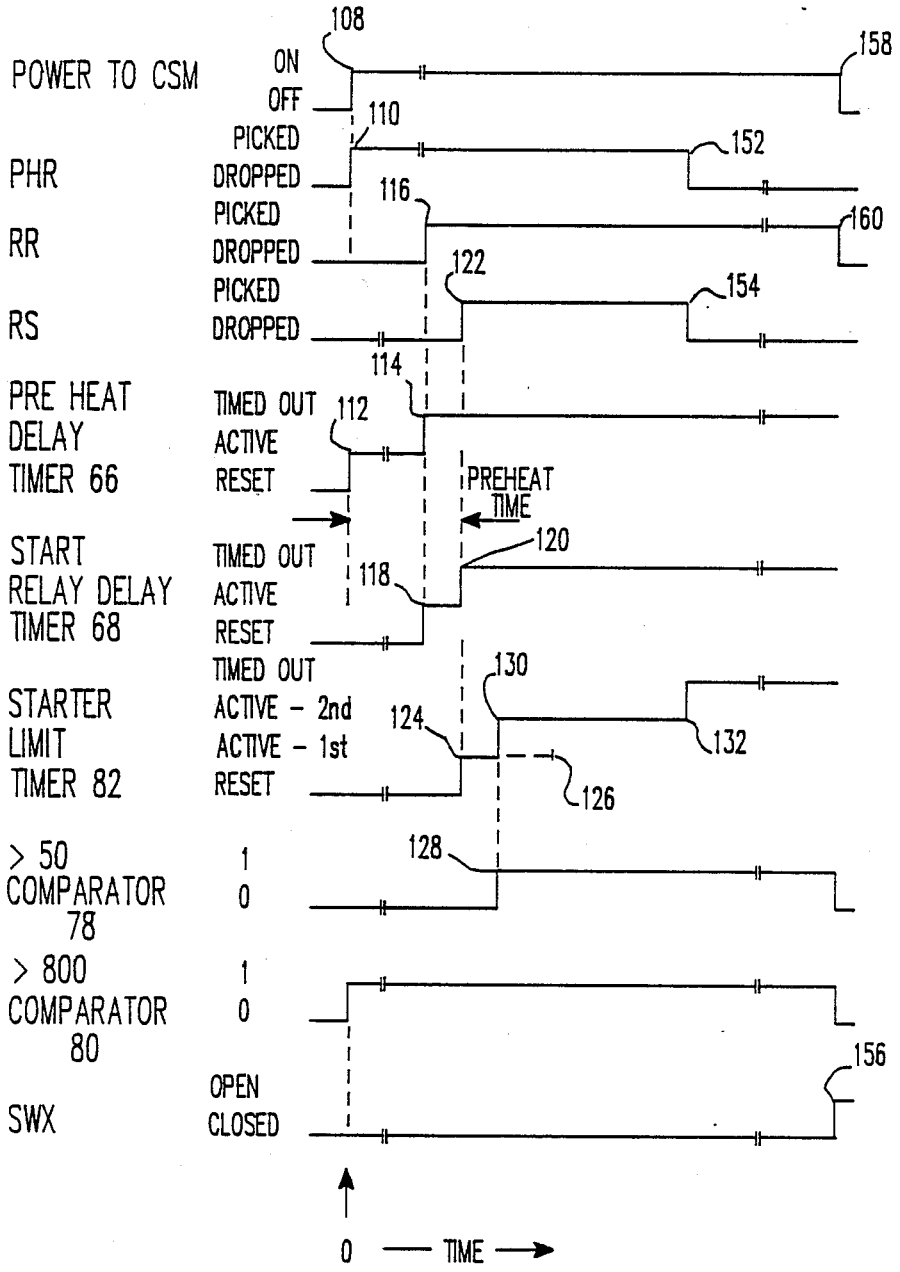
FIG. 7 is a timing diagram which illustrates the operation of the control module shown in FIG. 4 for a failure of the Diesel engine speed to exceed a second predetermined value within a second predetermined period of time, after the threshold set forth relative to FIG. 6 is met.

The timing diagram of FIG. 7 indicates the operation of control module CSM when engine 18 exceeds 50 RPM before the end of the first timing period, but the engine fails to exceed 800 RPM before the end of the second timing period. Instead of comparator 80 switching low before timer 82 times out at 132, when point 132 is reached, preheat and start relays PHR and RS drop at 152 and 154, respectively. The engine reset switch SWX opens its contacts 28 at point 156 removing power from control module CSM at 158 and dropping run relay RR at point 160.

We claim:

1. Electrical control apparatus for automatically starting a Diesel engine, comprising:

a starting solenoid, glow plugs, a fuel solenoid, start, preheat and run relays having switch contacts connected to respectively control the energization of said starting solenoid, glow plugs, and fuel solenoid, a control module for controlling the energization of said start, preheat and run relays following energization of the control module, and means for energizing said control module when the Diesel engine is to be automatically started, said control module including:

first logic means for controlling said preheat relay, said first logic means energizing the preheat relay when said control module is energized, to initiate energization of said glow plugs, first timer means for providing a glow plug preheat time related to the temperature of the Diesel engine, said first timer means providing a first signal for energizing the run relay prior to the completion of the preheat time, to energize the fuel solenoid, and a second signal at the completion of the preheat time, second logic means for controlling said start relay, said second logic means being responsive to the second signal of said first timer means, energizing the start relay in response thereto, to energize the starting solenoid, monitor means for monitoring the speed (RPM) of the Diesel engine, comparator means responsive to said monitor means for providing first and second signals at first and second predetermined RPM's, respectively, second timer means responsive to the second signal of the first timer means and to the first signal of the comparator means for providing a limit signal, said second timer means providing the limit signal after a first predetermined period of time, in the absense of the first signal, of the comparator means, said second timer means providing the limit signal after a second predetermined period of time upon receipt of the first signal prior to the end of said first predetermined period of time, said first and second logic means being responsive to said limit signal and to the second signal of said comparator means, said first and second logic means respectively de-energizing the preheat relay and the start relay in response to the first to occur of said limit and second signals.

2. The apparatus of claim 1 wherein the first timer means locks out the start relay after it is de-energized, until the control module is de-energized and re-energized.

3. The apparatus of claim 1 wherein the run relay remains energized following de-energization of the start relay, and including an engine reset switch and a low oil pressure switch connected in an electrical circuit energized by the switch contacts of the energized run relay, said engine reset switch being connected to de-energize the control module, which de-energizes the run relay, when the low oil pressure switch is closed, indicating the Diesel engine has failed to start after a period of time sufficient for a normal engine start.

4. The apparatus of claim 1 including means for resetting the first timer means when the control module is energized, and means for resetting the second timer means in response to the second signal of the first timer means.

5. The apparatus of claim 1 wherein the first timer means includes first and second timers which respectively provide the first and second signals, and including means for resetting the first timer when the control module is energized, and means responsive to the first signal for resetting the second timer.

6. The apparatus of claim 1 wherein the second timer means is a single timer with programmable timing periods, and wherein the first signal of the comparator means, when received prior to the end of the first period of time, re-programs said single timer to select the second timing period.

7. The apparatus of claim 6 including means for resetting the second timer in response to the first signal of the comparator means.

8. The apparatus of claim 1 including a power supply for having a negative temperature coefficient resistor and a capacitor connected to improve cold temperature starting of the Diesel engine.

9. The apparatus of claim 1 including relay drivers for driving the start, preheat and run relays, said relay drivers being selected to provide a resistance which is sufficiently low to prevent relay drop out on voltage dips which may occur when the starting solenoid is energized.

10. The apparatus of claim 1 wherein the switch contacts of the start, preheat and run relays which respectively control the energization of said starting solenoid, glow plugs, and fuel solenoid are single-pole, single throw.

11. A method of automatically starting a Diesel engine via electrical control which includes a starting solenoid, glow plugs, and a fuel solenoid, start, preheat and run relays for respectively controlling the energization of said starting solenoid, glow plugs, and fuel solenoid, and a control module for controlling the energization of said start, preheat and run relays following energization of the control module, by the steps of:

energizing the preheat relay to energize the glow plugs upon energization of the control module, determining the temperature of the Diesel engine, timing the energization of the glow plugs to provide a glow plug preheat time related to the temperature of the Diesel engine, energizing the run relay prior to the completion of the preheat time, to energize the fuel solenoid, energizing the start relay upon completion of the preheat time, to energize the starting solenoid, monitoring the speed (RPM) of the Diesel engine, de-energizing the start and preheat relays a first predetermined period of time after energization of the start relay when engine speed does not reach a first predetermined RPM during the first predetermined period of time, de-energizing the start and preheat relays a second predetermined period of time after energization of the start relay, when engine speed reaches the first predetermined RPM during the first predetermined period time but fails to reach a second predetermined RPM during the second predetermined period of time, and de-energizing the start preheat relays in response to the engine speed exceeding the second predetermined RPM before expiration of the second predetermined period of time.

12. The method of claim 11 including the step of locking out the start relay after it is de-energized, until electrical power has been removed from the control module and re-applied.

13. The method of claim 11 including the steps of:

maintaining energization of the run relay following de-energization of the start relay, providing a low oil pressure switch which is closed in response to low oil pressure, and an engine reset switch, connecting the low oil pressure switch and engine reset switch in an electrical circuit by the energized run relay, and removing electrical power from the electrical circuit and control module in response to said reset switch when the low oil pressure switch is closed after a period of time sufficient for a normal engine start.

* * * * *